US008978432B2

(12) United States Patent
Christianson et al.

(10) Patent No.: US 8,978,432 B2
(45) Date of Patent: Mar. 17, 2015

(54) MULTI-STAGE TUBE HYDROFORMING PROCESS

(71) Applicant: Caterpillar Inc., Peoria, IL (US)

(72) Inventors: Scott Christianson, Edelstein, IL (US); Murray Mason, Ontario (CA)

(73) Assignee: Caterpillar Inc., Peoria, IL (US)

( * ) Notice: Subject to any disclaimer, the term of this patent is extended or adjusted under 35 U.S.C. 154(b) by 178 days.

(21) Appl. No.: 13/764,890

(22) Filed: Feb. 12, 2013

(65) Prior Publication Data

US 2014/0223983 A1 Aug. 14, 2014

(51) Int. Cl.
*B21D 26/02* (2011.01)
*B21D 39/08* (2006.01)
*B21D 26/033* (2011.01)

(52) U.S. Cl.
CPC ..... *B21D 26/033* (2013.01)
USPC ..... 72/58; 72/62; 72/370.22; 29/421.1

(58) Field of Classification Search
USPC ..... 72/57, 58, 61, 62, 370.22; 29/421.1
See application file for complete search history.

(56) References Cited

U.S. PATENT DOCUMENTS

| | | | | |
|---|---|---|---|---|
| 5,070,717 | A * | 12/1991 | Boyd et al. | 72/55 |
| 6,016,603 | A | 1/2000 | Marando et al. | |
| 6,237,382 | B1 | 5/2001 | Kojima et al. | |
| 6,257,035 | B1 * | 7/2001 | Marks et al. | 72/57 |
| 6,912,884 | B2 | 7/2005 | Gharib | |
| 7,204,114 | B2 | 4/2007 | Ni et al. | |
| 8,171,769 | B2 * | 5/2012 | Barthelemy et al. | 72/370.22 |
| 8,505,349 | B2 * | 8/2013 | Golovashchenko | 72/58 |
| 8,826,712 | B1 * | 9/2014 | Luckey et al. | 72/58 |
| 2012/0047979 | A1 | 3/2012 | Hertell et al. | |
| 2012/0161474 | A1 | 6/2012 | Gerke et al. | |

FOREIGN PATENT DOCUMENTS

| | | |
|---|---|---|
| JP | 2001009528 | 1/2001 |
| JP | 2004255445 | 9/2004 |
| JP | 2005095983 | 4/2005 |

* cited by examiner

*Primary Examiner* — David B Jones
(74) *Attorney, Agent, or Firm* — BakerHostetler

(57) ABSTRACT

A method for hydroforming a tubular blank comprising the steps of at least partially closing the die portions of a die about a tubular blank, introducing a hydraulic fluid into the tubular blank at a first pressure, substantially closing the die portions about the tubular blank, partially opening the die while at least initially maintaining the pressure of the hydraulic fluid, and substantially closing the die portions at least a second time.

20 Claims, 7 Drawing Sheets

MULTI-STAGE TUBE HYDROFORMING PROCESS

TECHNICAL FIELD

The present disclosure generally relates to tube hydroforming processes, and more particularly, methods for hydroforming tubes used, e.g., in roll over protection system structures.

BACKGROUND

Sometimes it is desired to have a tubular structure made of a malleable metal, including but not limited to steel, aluminum, etc., having a specific cross-sectional profile for specifically defined applications. However, such tubes for use as tubular blanks are generally sold by suppliers having standard circular (or other) cross-sections. Accordingly, for use in specific applications, the tubes must be formed into a desired cross-section. Furthermore, in many cases, particularly where such tubes will be used in structural applications, it is important that the structural integrity of the tube is not damaged or weakened by the desired cross-sectional forming operation.

Some non-limiting applications in which tubular structures such as these may be used include in the auto and biking industries. Other non-limiting examples include in the forming of cab frames of mobile machines, such as earthmoving machines, excavation-type machines, mining machines, and the like. In the case of cab frames for mobile machines, these frames may be made up of dozens of separate tubes which may be welded together to produce the desired shape of the cab frame, as well as to provide the cab frame with portions meeting different dimensional and strength requirements. In applications such as these, in order for the cab frame to be strong enough so that it may provide protection to the person in the cab during a rollover, structural integrity of the tubes being used is relatively important.

It has been found that hydroforming is particularly useful as a relatively cost-effective way of shaping and forming tubular blanks of ductile metals into lightweight, structurally stiff and strong pieces for the applications discussed above. In particular, hydroformed tubular structures can often be made with a higher stiffness-to-weight ratio and at a lower per unit cost than traditionally formed tubes. It has been found that virtually all metals capable of cold forming can be hydroformed, including aluminum, brass, carbon and stainless steel, copper, and high strength alloys.

More specifically, in a traditional tubular hydroforming process, a hollow blank tube may be placed inside a half of a negative die mold that, when combined with a complementary die portion, has the cross-sectional shape of the desired resulting part. When the dies are closed, the tube ends are sealed, generally by axial punches, and the tube is filled with pressurized hydraulic fluid. The internal hydraulic pressure then causes the tube to expand against the die. After a period of time, the pressure is released allowing some of the fluid to be released from the tube. The tube ends are then unsealed, allowing egress of the remaining hydraulic fluid, the die halves are opened, and the resulting hydroformed part may be removed.

Traditional hydroforming processes such as this have been found useful in the past due to the fact that they generally allow for the forming of parts with a higher stiffness-to-weight ratio and at a lower per unit cost than other techniques. However, prior art tubular hydroforming processes do have some drawbacks.

Specifically, when hydroforming tubes having relatively high wall-thickness and/or bends having relatively tight corner radii, it has been found that conventional low pressure hydroforming processes are inadequate to achieve the desired cross-section of the finished tubes. Conversely, it has been found that conventional high pressure hydroforming processes can result in undesirable thinning of the cross-section of the finished product, thereby weakening the structural integrity of the resulting part. Further, regardless of whether conventional low pressure or high pressure hydroforming methods have been used, there have been situations where springback (the dimensional change of the deformed part after unloading caused by elastic recovery) issues have been problematic.

In this regard, U.S. Pub. No. 2010/0186477 A1 entitled "Method of Forming a Flanged Tubular Member in Hydroforming" discloses a tube hydroforming method whereby a combination of low pressure and high pressure hydroforming processes are used to create a final part having a flange. However, the method disclosed in that publication is not believed to resolve the wall part thinning and springback issues that can be particularly problematic in instances when the final part is required to have significant structural integrity. Additionally, the two-step process disclosed in that publication requires the use of two separate dies, which adds to cost and complexity of the part forming process, and is specifically directed at finished tubular parts having a flange thereon.

SUMMARY OF THE INVENTION

The present disclosure is directed to a method for forming a finished tube having a desired cross-section from a tubular blank using a hydroforming process.

Specifically, one embodiment of the present method for hydroforming a finished tube having a desired cross-section from a tubular blank in accordance herewith may include the steps of: (1) at least partially closing the die portions of a die about a tubular blank disposed in the die; (2) introducing a hydraulic fluid into the tubular blank at a first pressure; (3) substantially closing the die portions about the tubular blank for a first instance to form a first intermediate form tube; (4) partially opening the die by moving the die portions relatively away from one another to form a gap therebetween while at least initially maintaining the pressure of the hydraulic fluid within the first intermediate form tube to allow at least a partial expansion of a cross-section of the first intermediate form tube; and (5) substantially closing the die portions around the first intermediate form tube at a second instance. Optional steps included within embodiments of the present disclosure include repeating steps 4 and 5 as necessary (depending on the application) and increasing the fluid pressure of the hydraulic fluid after either step 3 or step 5.

Another embodiment of the present method for hydroforming a finished tube having a desired cross-section from a tubular blank in accordance herewith may include the steps of: (1) positioning a tubular blank in a die; (2) partially closing the die; (3) introducing pressurized hydraulic fluid into the tubular blank; (4) substantially closing the die a first time; (5) partially opening the die; (6) substantially closing the die at least a second time; (7) releasing the hydraulic fluid pressure; and (8) opening the die to release a finished tube. Optional steps included within embodiments of the present disclosure include repeating steps 5 and 6 as necessary (depending on the application) and increasing the fluid pressure of the hydraulic fluid after either step 4 or step 6.

DETAILED DESCRIPTION

Figure 1:
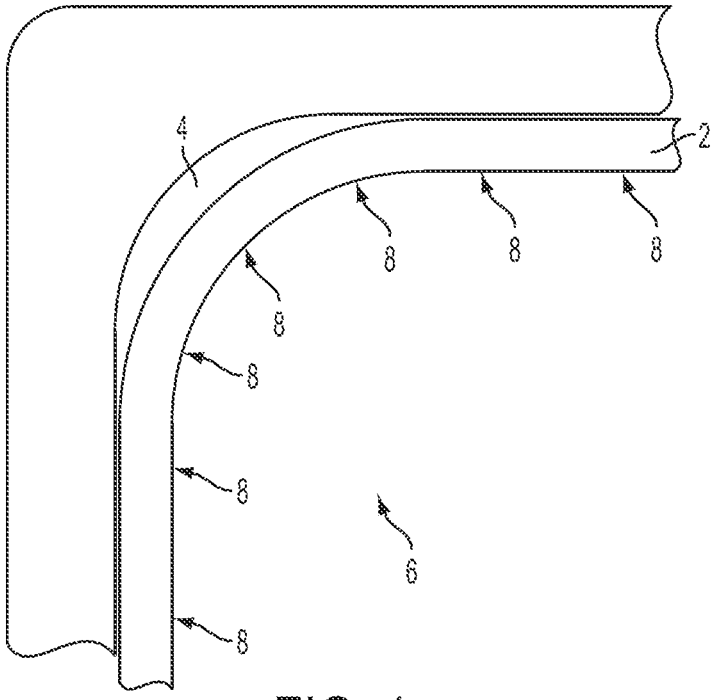
FIG. 1 PRIOR ART
FIG. 1 is a cross-sectional view of a prior art finished tube in a die formed via a prior art low pressure hydroforming process.

Referring first to FIG. 1, the result of a prior art low pressure tubular hydroforming method is shown wherein a prior art finished tube 2 does not fully conform to a die cavity 6 leaving a gap 4 due to the fact that the walls of the prior art finished tube 2 are too thick to allow the pressure of the hydraulic fluid 8 to fully deform the prior art finished tube 2.

Figure 2:
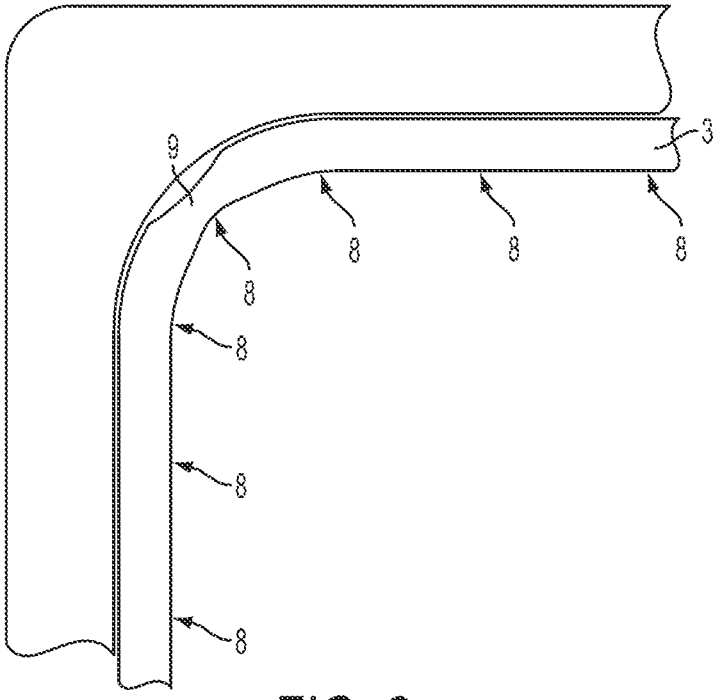
FIG. 2 PRIOR ART
FIG. 2 is a cross-sectional view of a prior art finished tube in a die formed via a prior art high pressure hydroforming process.

Referring to FIG. 2, the result of a prior art high pressure tubular hydroforming method is shown wherein a prior art finished tube 3 has a wall 9 that has thinned due to the fact that the prior art die method has worked the wall 9 of the prior art finished tube 3 too extensively prior to the application of the hydraulic fluid 8 pressure.

Figure 3:
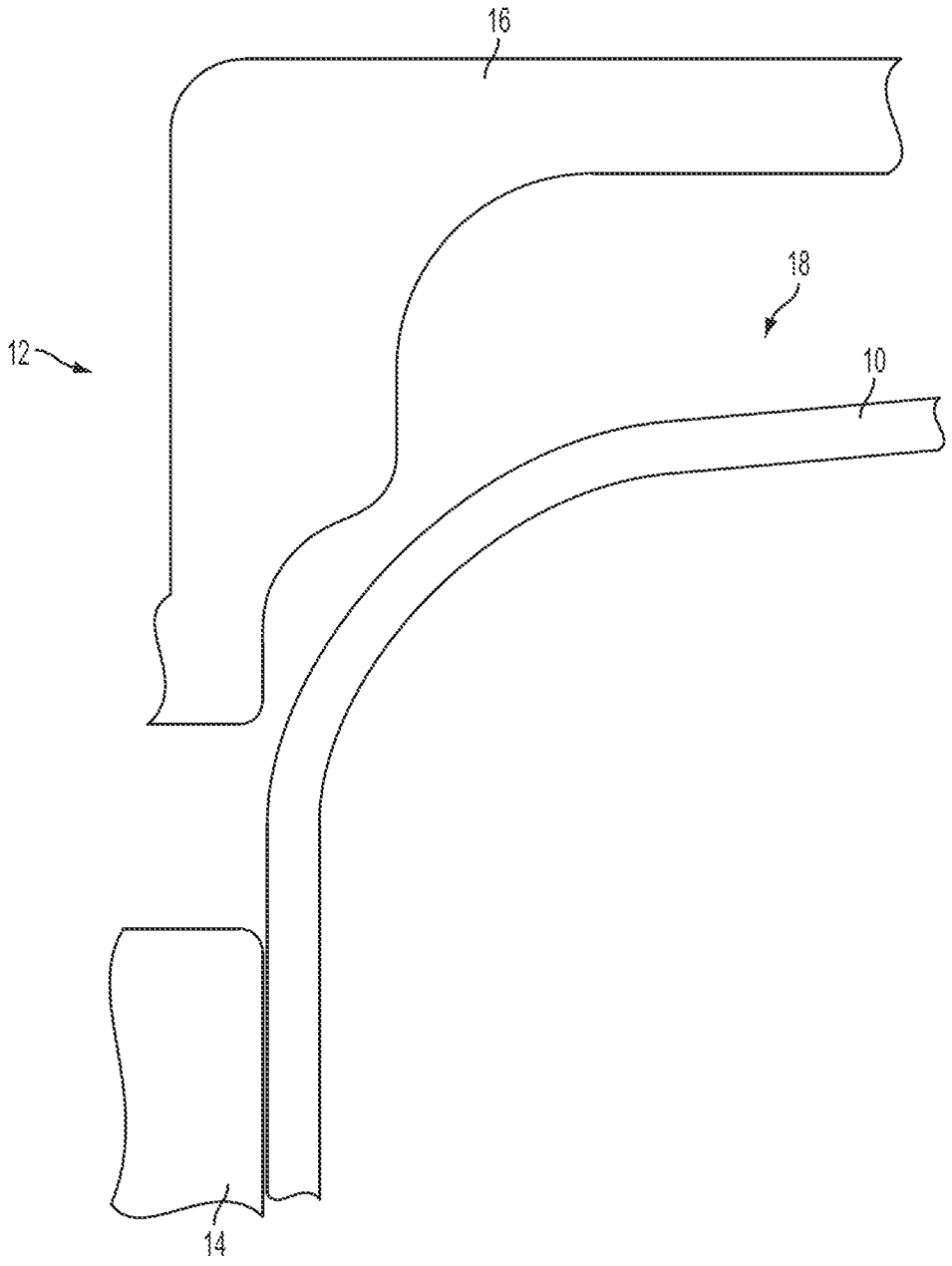
FIG. 3 is a cross-sectional view of a tubular blank in a die prior to any work being done thereon in accordance with an aspect of the present disclosure.

Referring to FIG. 3, in a method according to the present disclosure, a tubular blank 10 is shown disposed within a hydroform die 12 composed of a first die portion 14 and a second die portion 16, wherein the die portions may represent lower, upper, left, right, etc. portions of a die 12 depending on the application and the orientation of the die 12. The tubular blank 10 is depicted prior to any work being performed thereon and prior to the introduction of any pressurized hydraulic fluid therein. Consistent with this embodiment, the first die portion 14 and second die portion 16, when combined, form to create a hydroforming die cavity 18 having a cross-sectional dimension as desired for a final hydroformed part.

Figure 4:
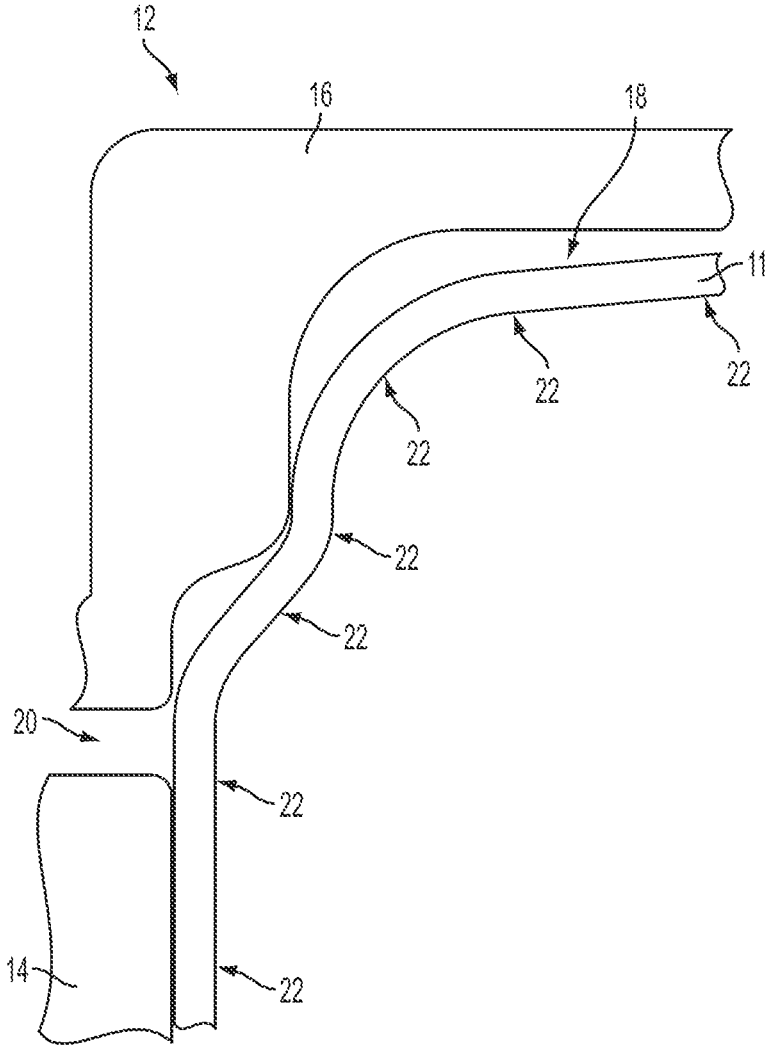
FIG. 4 is a cross-sectional view of an intermediate form tube in a die in a first phase of a hydroforming process in accordance with an aspect of the present disclosure.

Referring to FIG. 4, further in accordance with an embodiment of the disclosure, an intermediate form tube 11 is formed by the initial compression of the first die portion 14 and the second die portion 16, wherein the die portions 14, 16 are in an intermediate form position (i.e. not completely closed) thereby creating a gap 20 therebetween. The gap 20 created in the intermediate foam position for the die portions 14, 16 may vary from application to application and may be dependent on the desired amount of cold work desired on the part at any particular point in the process, but, consistent with the disclosure, may be between approximately 5 mm and approximately 20 mm, or more particularly, approximately 15 mm. The ends of the intermediate form tube 11 may then be sealed in a manner and fashion as is known in the art and a hydraulic fluid 22 at a first pressure may be introduced therein. Initially, such first pressure may be a pressure in the range generally used in low pressure hydroforming processes, namely approximately between 100 and 500 bar, and more particularly, approximately 300 bar.

Figure 5:
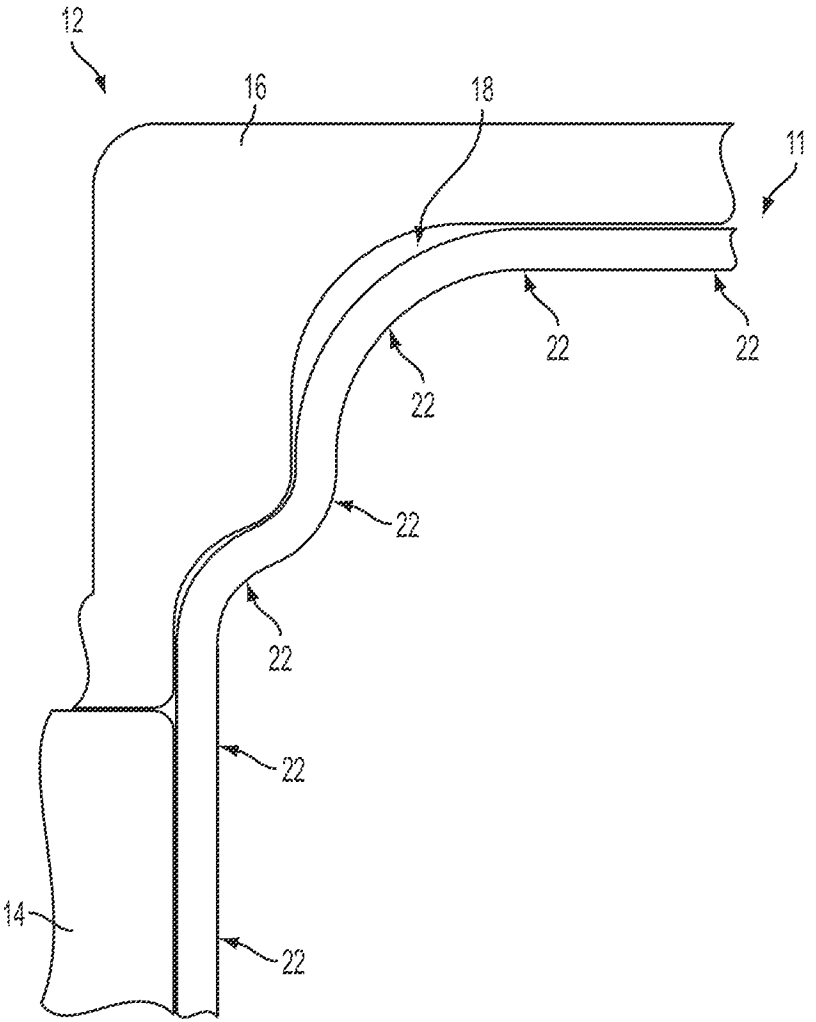
FIG. 5 is a cross-sectional view of an intermediate form tube in a die in a second phase of a hydroforming process in accordance with an aspect of the present disclosure.
Figure 7:
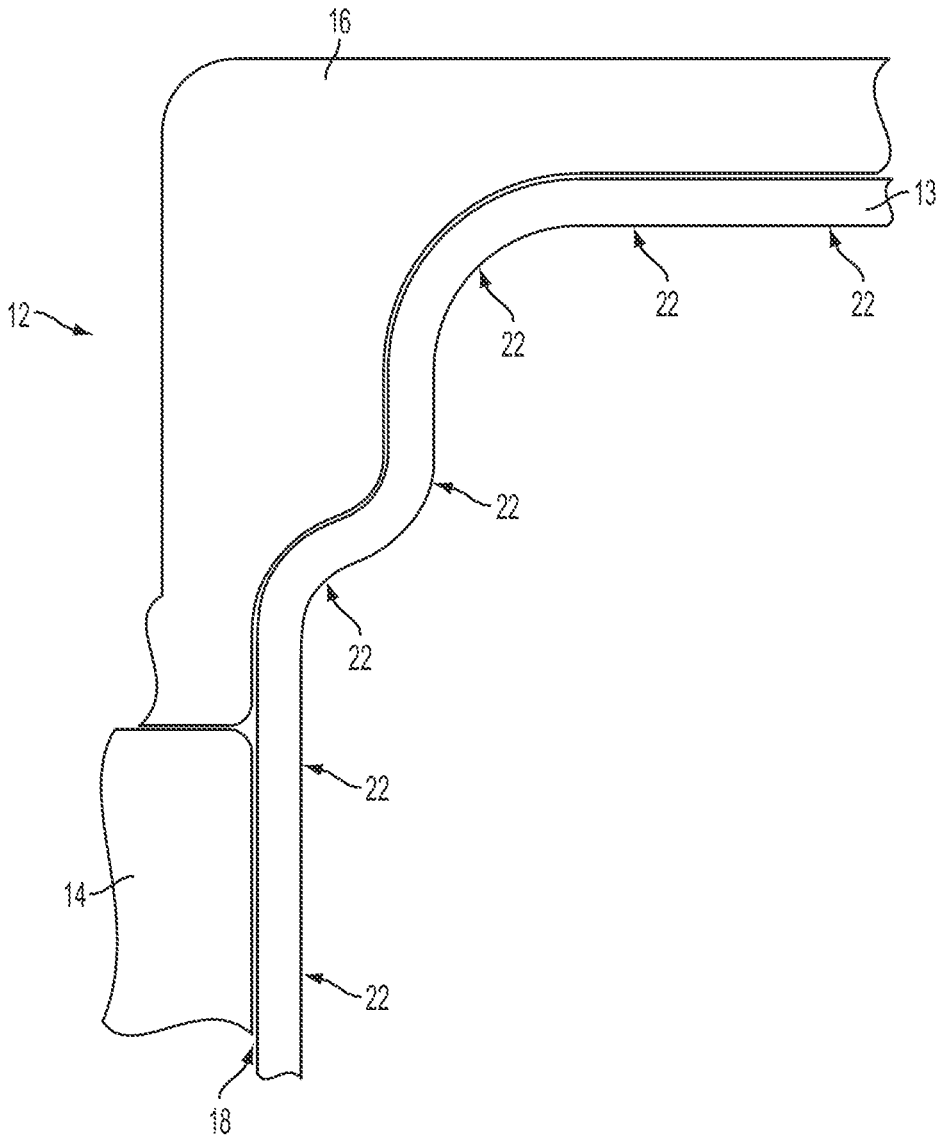
FIG. 7 is a cross-sectional view of a finished tube in a die in a final phase of a hydroforming process in accordance with an aspect of the present disclosure.

As shown in FIG. 5, the die 12 may then be operated such that the first die portion 14 and the second die portion 16 are moved relatively closer to one another to a substantially closed position. For example, the first die portion 14 may be closed up on the second die 16 (or the second die 16 may be closed upon the first die 14, or the first 14 and second 16 dies may be closed upon each other) to form die cavity 18. The hydraulic fluid 22 at a first pressure continues work on the intermediate form tube 11 by deforming the intermediate form tube 11 within the die cavity 18. Optionally, at this time, the pressure of the hydraulic fluid 22 may be increased to a pressure more generally associated with high pressure hydroforming processes, namely approximately between 800 and 1500 bar, and more particularly, approximately 1100 bar.

Figure 6:
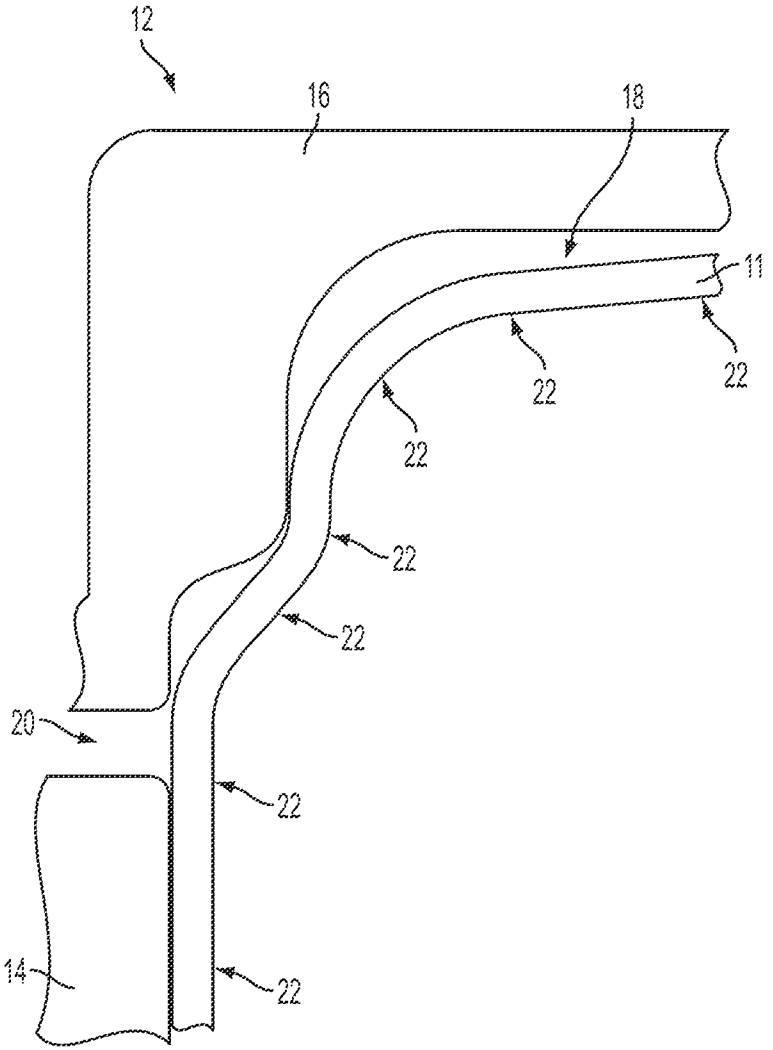
FIG. 6 is a cross-sectional view of an intermediate form tube in a die in a third phase of a hydroforming process in accordance with an aspect of the present disclosure.
Figure 8:
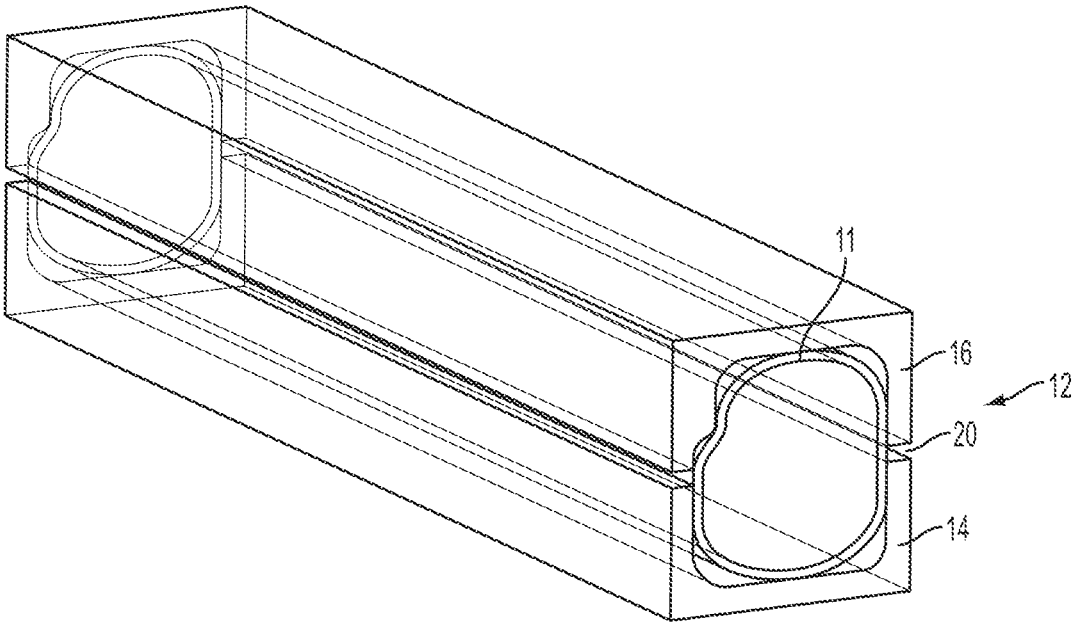
FIG. 8 is a side perspective view of an intermediate form tube in a die in a third phase of a hydroforming process in accordance with an aspect of the present disclosure.

Next, as best shown in FIG. 6 and FIG. 8 (either concurrent with the rise in pressure of the hydraulic fluid 22 or shortly thereafter (if utilized), the first die portion 14 and second die portion 16 may be moved relatively away from each other, such as, e.g., separated (using any of the methods discussed above) to once again provide a gap 20 between the first and second die portions 14, 16. As discussed above, this intermediate form position for the die portions 14, 16, may vary from application to application, and may be dependent on the desired amount of cold work desired on the finished part (as well as the size of the intermediate form tube 11). As above, it has been found that a gap 20 between approximately 5 mm and approximately 20 mm is operable in the context of the present disclosure, as is a gap 20 of approximately 15 mm.

Figure 9:
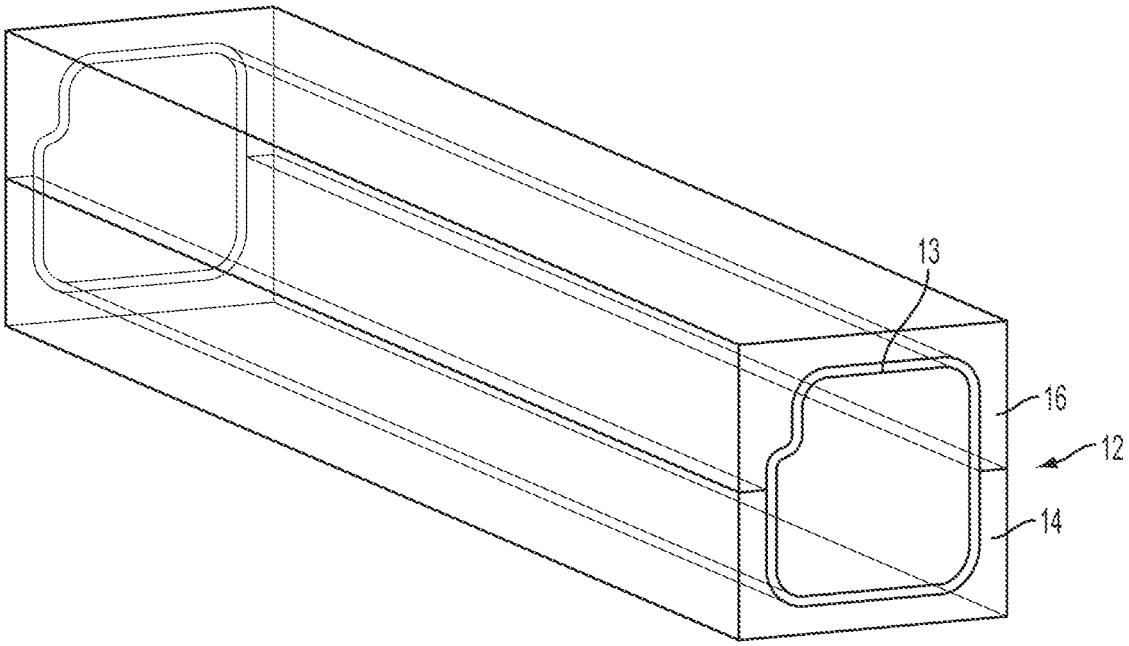
FIG. 9 is a side perspective view of a finished tube in a die in a final phase of a hydroforming process in accordance with an aspect of the present disclosure.

As shown best in FIGS. 6 and 9, the die 12 may be finally operated to compress the intermediate form tube 11 which still includes hydraulic fluid 22 (either at the first pressure, or if utilized, at the second pressure, or even at another pressure if desired) providing the final desired cold work on the intermediate form tube 11 to form the finished tube 13 in closer conformity to the geometry of the die cavity 18. Depending on the final finished tube 13 geometry desired (as well as other factors), these last two steps may be performed a single time or multiple times. Further, if the final compression steps are performed multiple times, the gap 20 size may be lowered on each successive compression and/or the pressure of the hydraulic fluid 22 may be modified. Specifically, the pressure of the hydraulic fluid 22 may be maintained at whatever pressure was utilized previously (either the first pressure or the second pressure) or may be adjusted to a different pressure, including, but not limited to, the first or second pressure, or some pressure therebetween. In this manner, the desired geometry for the finished tube 13 may be achieved according to the method disclosed herein.

Figure 10:
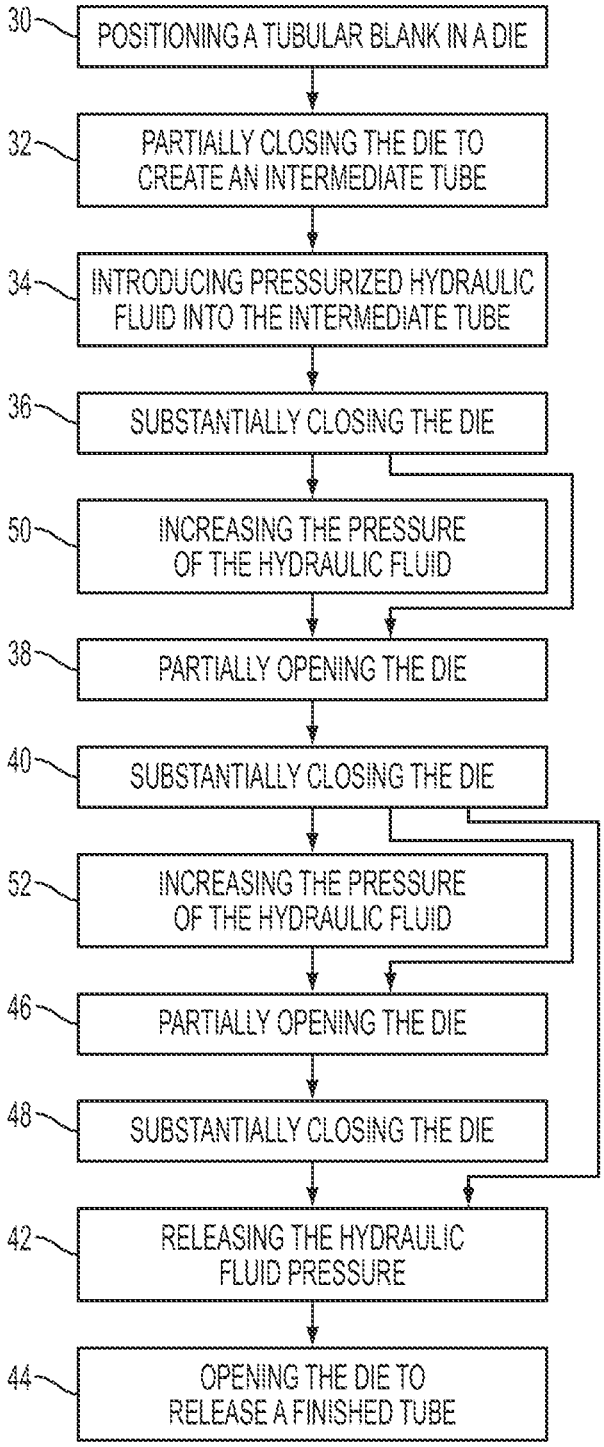
FIG. 10 is a flow chart illustrating some embodiments consistent with an aspect of the present disclosure.

As shown in FIG. 10, multiple embodiments of the present disclosure are illustrated. Specifically, steps of the process in accordance with one aspect of the disclosure, may include: (1) positioning a tubular blank in a die 30; (2) partially closing the die 32; (3) introducing pressurized hydraulic fluid into the tubular blank 34; (4) substantially closing the die a first time 36; (5) partially opening the die 38; (6) substantially closing the die at least a second time 40; (7) releasing the pressure of the hydraulic fluid 42; and (8) opening the die to release a finished tube 44. Optional steps included within embodiments of the present disclosure include partially opening the die 46 and substantially closing the die 48 as many times as necessary (depending on the application) and increasing the pressure of the hydraulic fluid 50, 52 at various stages of the process.

It is noted that although the method of this disclosure is explained and illustrated in conjunction with a linearly extending tube it is to be understood and appreciated by a person of ordinary skill in the art that the method in accordance with this disclosure may be used in conjunction with a tube that has been pre-bent, such as in a conventional tube bending apparatus, to have one or more bends therein.

Similarly, while the initial blank for the tubular blank 10 shown herein is circular in cross-section in the illustrated figures, it will be understood that initial blanks of the tubular blank 10 having other initial cross-sections (including oval, square, rectangular, etc.) would be operable in accordance with the scope of the present disclosure. In accordance herewith, it is also noted that sealing of the hydraulic fluid 22 within the intermediate form tube 11 in any manner known by those of ordinary skill in the hydroforming art including, but not limited to, the use of sealing cones or sealing tubes.

Further, it is to be understood that the wall thickness of the tubular blank 10 may be any suitable thickness. In an embodiment consistent with the disclosure, this wall thickness may range from approximately 4 mm to approximately 10 mm, and more particularly, between approximately 6 mm and 8 mm. It is to be further understood that any suitable materials may be used to form the tubular blank 10. For example, suitable materials include, but are not limited to high strength low alloy steel, dual phase steel, transformation induced plasticity (TRIP) steels, and Martensite steel (as well as combinations and/or alloys thereof).

INDUSTRIAL APPLICABILITY

Mobile machines, such as earthmoving machines, excavation-type machines, mining machines, or the like, may be employed for earthmoving, excavation, mining, or other operations. Such mobile machines often require an operator who sits in a cabin or cab that is connected to the machine. Often, the frame of the cab includes an integrated roll over protection system (ROPS). As its name describes, the purpose of the ROPS is to provide a structure that may prevent the cab frame and the cab from being crushed in a rollover.

Often times, the cab frame in a ROPS may be constructed from numerous hollow metal tubes. Each individual tube in such a structure may generally be straight and may have a constant cross section. Tubes of different lengths, having different interior and/or different exterior dimensions, may be used. In many cases, the cab frame may be made up of dozens of these separate, differently-sized tubes. Such tubes may be created using the method in accordance with the present disclosure. Furthermore, tubes created in accordance with the method of the present disclosure may be used in many other industries and for many other purposes including the automotive industry and in connection with high strength tubular bike frames and the like.

Further in accordance with the foregoing, it may be desired to have a process for producing final tubular parts having a desired cross-section from tubular blanks having relatively thick walls (e.g. approximately 4 mm or greater), having a high degree of structural integrity, that conform relatively closely with the die used to form the finished tube, and that do not exhibit excessive springback issues and/or wall-thinning associated with tubular parts made by prior art processes, and in particular, prior art hydroforming processes.

Accordingly, the method disclosed herein has been found to lessen the bending springback of the finished part resulting in an improved finished part cross-section conformance to die cavity geometry. Further, the method in accordance with the present disclosure has been found to generally improve the conformance of the corner radii of the part in question to the die cavity while maintaining desired wall-thickness and rigidity. Thus the method in accordance with the present disclosure can potentially allow for tighter corner radii to be achieved than had previously been achieved using either a conventional low pressure hydroforming process or a conventional high pressure hydroforming process.

The many features and advantages of the disclosure are apparent from the detailed specification, and, thus, it is intended by the appended claims to cover all such features and advantages of the disclosure which fall within its true spirit and scope. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. A method for hydroforming a tubular blank comprising the steps of:

at least partially closing the die portions of a die about a tubular blank disposed in the die;

introducing a hydraulic fluid into the tubular blank at a first pressure;

substantially closing the die portions about the tubular blank for a first instance to form a first intermediate form tube;

partially opening the die by moving the die portions relatively away from one another to form a gap therebetween while at least initially maintaining the pressure of the hydraulic fluid within the first intermediate form tube to allow at least a partial expansion of a cross-section of the first intermediate form tube; and substantially closing the die portions around the first intermediate form tube at a second instance.

2. The method for hydroforming a tubular blank of claim 1 further comprising the step of increasing the pressure of the hydraulic fluid to a second pressure after said die portions are substantially closed at the first instance, wherein the second pressure is higher than the first pressure.

3. The method for hydroforming a tubular blank of claim 1 further comprising the step of increasing the pressure of the hydraulic fluid to a second pressure after said die portions are substantially closed at the second instance, wherein the second pressure is higher than the first pressure.

4. The method for hydroforming a tubular blank of claim 1 further comprising repeating the steps of partially opening the die by moving the die portions relatively away from one another to form a gap therebetween while at least initially maintaining the pressure of the hydraulic fluid within the first intermediate form tube; and substantially closing the die portions around the first intermediate form tube at a second instance.

5. The method for hydroforming a tubular blank of claim 1 wherein the step of partially opening the die by moving the die portions relatively away from one another to form a gap therebetween includes opening the die such that the gap is approximately between 5 mm and 20 mm.

6. The method for hydroforming a tubular blank of claim 1 wherein the step of introducing a hydraulic fluid into the intermediate form tube at a first pressure includes the step of introducing the hydraulic fluid at a pressure between approximately 100 bar and 500 bar.

7. The method for hydroforming a tubular blank of claim 2 wherein the step of increasing the pressure of the hydraulic fluid to a second pressure after said die portions are substantially closed for the first time includes the step of increasing the pressure of the hydraulic fluid to between approximately 800 bar and 1500 bar.

8. The method for hydroforming a tubular blank of claim 1 wherein, prior to the step of at least partially closing the die portions of a die about a tubular blank disposed in the die, a tubular blank is selected having a wall thickness between approximately 4 mm and 10 mm.

9. The method for hydroforming a tubular blank of claim 1 further comprising repeating the steps of partially opening the die by moving the die portions relatively away from one another to form a gap therebetween while at least initially maintaining the pressure of the hydraulic fluid within the first intermediate form tube and substantially closing the die portions around the first intermediate form tube at a second instance at least two times.

10. The method for hydroforming a tubular blank of claim 1 wherein, after the step of substantially closing the die portions around the first intermediate form tube at a second instance, incorporating the first intermediate form tube in a roll over protection system.

11. The method for hydroforming a tubular blank of claim 1 wherein the step of at least partially closing the die portions of a die about a tubular blank disposed in the die includes closing the die portions such that there is a gap of approximately between 5 mm and 20 mm between the die portions.

12. A method for hydroforming a tubular blank comprising the steps of:

positioning a tubular blank in a die, said die having a first portion and a second portion;

partially closing the die portions upon the tubular blank to create an intermediate form tube;

introducing a hydraulic fluid into the intermediate form tube at a first pressure;

substantially closing the die portions on the intermediate form tube a first time;

partially opening the die by moving the die portions relatively away from one another to form a gap therebetween while maintaining the pressure of the hydraulic fluid thereby allowing the intermediate form tube to at least partially expand;

substantially closing the die portions on the intermediate form tube a second time;

partially opening the die by moving the die portions relatively away from one another to form a gap therebetween while maintaining the pressure of the hydraulic fluid thereby allowing the intermediate form tube to at least partially expand;

substantially closing the die portions on the intermediate form tube a third time.

13. The method for hydroforming a tubular blank of claim 12 further comprising the step of increasing the pressure of the hydraulic fluid to a second pressure after said die portions are substantially closed for the first time, wherein the second pressure is higher than the first pressure.

14. The method for hydroforming a tubular blank of claim 12 further comprising the step of increasing the pressure of the hydraulic fluid to a second pressure after said die portions are substantially closed for the second time, wherein the second pressure is higher than the first pressure.

15. The method for hydroforming a tubular blank of claim 12 further comprising the step of increasing the pressure of the hydraulic fluid to a second pressure after said die portions are substantially closed for the third time, wherein the second pressure is higher than the first pressure.

16. The method for hydroforming a tubular blank of claim 12 wherein the step of partially opening the die by moving the die portions relatively away from one another to form a gap therebetween includes opening the die such that the gap is approximately between 5 mm and 20 mm.

17. The method for hydroforming a tubular blank of claim 12 wherein the step of introducing a hydraulic fluid into the intermediate form tube at a first pressure includes the step of introducing the hydraulic fluid at a pressure between approximately 100 bar and 500 bar.

18. The method for hydroforming a tubular blank of claim 15 wherein the step of increasing the pressure of the hydraulic fluid to a second pressure after said die portions are substantially closed for the second time includes the step of increasing the pressure of the hydraulic fluid to between approximately 800 bar and 1500 bar.

19. A method for hydroforming a tubular blank comprising the steps of:

positioning a tubular blank in a die, said die having a first portion and a second portion;

partially closing the die portions upon the tubular blank to create an intermediate form tube;

introducing a hydraulic fluid into the intermediate form tube at a first pressure;

substantially closing the die portions on the intermediate form tube a first time;

increasing the pressure of the hydraulic fluid to a second pressure wherein the second pressure is higher than the first pressure;

partially opening the die by moving the die portions relatively away from one another to form a gap therebetween while maintaining the pressure of the hydraulic fluid thereby allowing the intermediate form tube to at least partially expand;

substantially closing the die portions on the intermediate form tube a second time;

partially opening the die by moving the die portions relatively away from one another to form a gap therebetween while maintaining the pressure of the hydraulic fluid at the second pressure thereby allowing the intermediate form tube to at least partially expand;

substantially closing the die portions on the intermediate form tube a third time.

20. The method for hydroforming a tubular blank of claim 19 wherein the step of introducing a hydraulic fluid into the intermediate form tube at a first pressure includes the step of introducing the hydraulic fluid at a pressure between approximately 100 bar and 500 bar.

* * * * *